United States Patent [19]

Karnobatsky et al.

[11] 3,931,898

[45] Jan. 13, 1976

[54] MACHINE FOR CONDITIONING ORE HEAT-TREATING FURNACE THROAT

[76] Inventors: Eduard Konstantinovich Karnobatsky, ulitsa Pobedy, 8b, kv. 26; Dmitry Grigorievich Linnik, Prospekt Lenina, 212, kv. 70; Ivan Yakovlevich Stovbur, ulitsa Patrioticheskaya, 74, kv, 27, all of Zaporozhie, U.S.S.R.

[22] Filed: Mar. 6, 1975

[21] Appl. No.: 555,721

Related U.S. Application Data

[63] Continuation of Ser. No. 435,017, Jan. 21, 1974, abandoned, which is a continuation of Ser. No. 323,400, Jan. 15, 1973, abandoned.

[52] U.S. Cl. ..... 214/32; 214/141; 214/145

[51] Int. Cl.[2] ..... F27B 3/18

[58] Field of Search ..... 214/23, 32, 33, 141, 145

[56] References Cited

UNITED STATES PATENTS

| | | | |
|---|---|---|---|
| 498,779 | 6/1893 | Foulis | 214/23 |
| 1,594,799 | 8/1926 | Smith | 214/23 |
| 2,984,373 | 5/1961 | Przybylski | 214/141 |
| 3,097,439 | 7/1963 | Calkin | 214/145 |

*Primary Examiner*—Robert G. Sheridan
*Attorney, Agent, or Firm*—Holman & Stern

[57] ABSTRACT

A machine for conditioning an ore heat-treating furnace throat in which there is provided a turnable column mounted on a self-propelled truck and carrying a guide bar for a beam with an actuating mechanism. The actuating mechanism is articulated on a hollow beam and constitutes a scraper with two side edges and one front edge, with the latter carrying a hinged rod, and an air cylinder adapted for traversing the actuating mechanism being located in the interior of said beam.

2 Claims, 5 Drawing Figures

MACHINE FOR CONDITIONING ORE HEAT-TREATING FURNACE THROAT

This is a continuation of application Ser. No. 435,017 filed Jan. 21, 1974, now abandoned, which in turn is a Rule 60 Continuation of application Ser. No. 323,400 filed Jan. 15, 1973, now abandoned.

BACKGROUND OF THE INVENTION

The present invention relates to machines for conditioning ore heat-treating furnace throats.

Known in the art is a machine for conditioning an ore heat-treating furnace throat comprising a column mounted on a self-propelled truck so that it is free to swing about a vertical axis and a tubular guide bar articulated with the column to allow it to rotate about a horizontal axis and adapted for accomodating a beam having one end carrying an actuating mechanism with its other end articulated with a movable member of an air cylinder whose stationary member is hinged to said tubular guide bar. The air cylinder is located outward of the tubular guide bar.

The above machine adapted for poking and raking-up the charge from the sides to the electrodes is furnished with the actuating mechanism being in the form of a steel rod. It fails to provide an adequate conditioning of the entire area of the furnace throat, insofar as it does not allow feeding the charge into the interelectrode space.

Moreover, the air cylinder adapted for axial transfer of the beam together with the actuating mechanism attached thereto is arranged on the exterior of the tubular guide bar, and is thus exposed to the effect of the mal radiation of the furnace which results in a reduction of its life period due to a breakdown of its sealing elements.

In the course of operation, when the machine working member is in its extreme positions, dynamic loads arising in the air cylinder may lead to a failure of the machine components.

Due to the inherent design of the actuating mechanisms, the known machines do not provide efficient mechanized conditioning of the furnace periphery and interelectrode space.

In addition, the machines feature short life periods.

OBJECTS AND SUMMARY OF THE INVENTION

The main object of the invention is to provide a machine which effects the efficient mechanized conditioning of the entire throat surface both at the periphery and in the interelectrode space.

Another object of the invention is to enhance functional reliability and life period of the machine by extending the life period of the sealing elements of a longitudinal feed cylinder and eliminating the dynamic loads arising when said cylinder is in operation.

the above and other objects are accomplished by the provision of a machine for conditioning ore heat-treating furnace throats comprising a column mounted on a selfpropelled truck so that it is free to swing about a vertical axis and a tubular guide bar articulated with one column in such a manner as to allow it to rotate about a horizontal axis and adapted for accommodating a beam having one end carrying an actuating machanism, with the other end being articulated with a movable member of an air cylinder whose stationary member is articulated with said tubular guide bar, in which machine, according to the invention, the actuating mechanism is hinged on a hollow beam and constitutes a scraper with two side edges and one front edge, the latter carrying a rod hinged thereto and the air cylinder adapted to traverse the actuating mechanism being located within the interior of said beam.

The above machine will provide a more efficient mechanized conditioning of both the throat periphery and interelectrode space. Moreover, it features a higher output and extended life period insofar as the air cylinder is not subject to thermal radiation of the furnace.

It is expedient that an air cylinder have plungers fastened to both sides of the piston and provided with grooves and valves for supplying compressed air into the chambers formed by cylinder covers arranged at the opposite end faces of the air cylinder.

With the above arrangement of the air cylinder, both the reliability and life period of the machine can be enhanced since the shock absorbing properties of compressed air eliminate the dynamic loads set up when the machine is in operation.

The invention is further exemplified by a detailed description of a specific embodiment thereof, to be had in conjunction with the accompanying drawings, wherein:

DETAILED DESCRIPTION OF THE INVENTION

Figure 1:
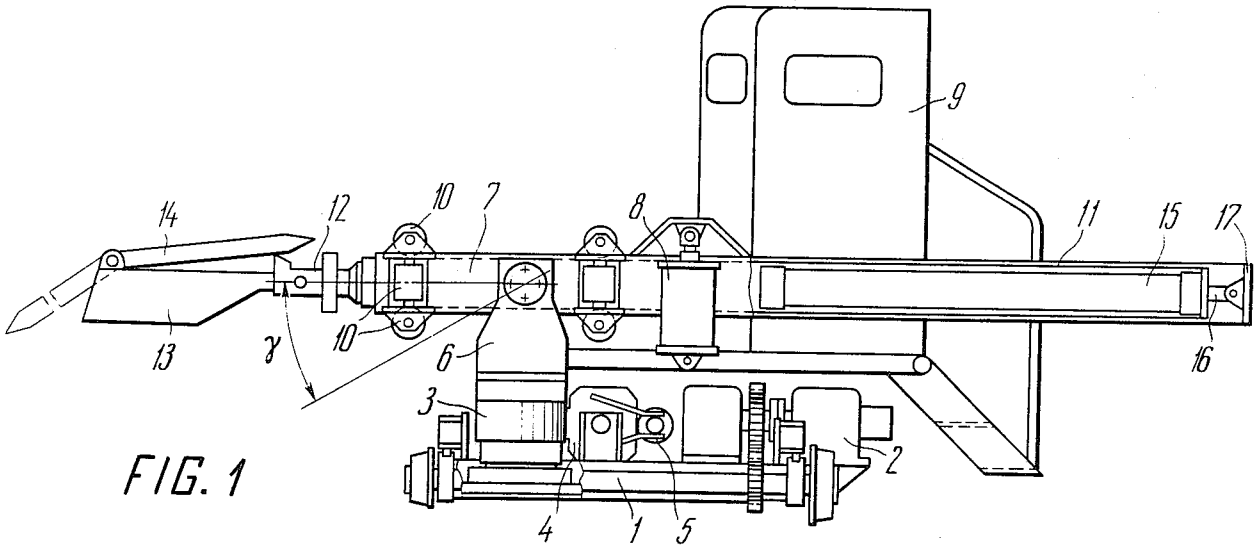
FIG. 1 is a side view of the machine, according to the invention.

The machine for conditioning ore heat-treating furnace throat is mounted on a self-propelled truck 1 (FIGS. 1 and 2) movable along a circular track by means of a reversing drive 2. Mounted on the truck 1 in such a manner that it is free to swing about a vertical axis is a column 3 provided with a toothed crown engaged in a rack connected with an air cylinder unit 4 which causes the column to rotate through angles " $\beta$ " and " $\alpha$ ". Smooth rotation of the column 3 is provided by a hydraulic shock absorber 5.

Articulated to the column 3, with the aid of a fork 6, is a tubular guide bar 7 inclinable through an angle " $\gamma$ " by an air cylinder unit 8 resting on the frame of a cabin 9 rigidly fixed to the fork 6.

The tubular guide bar 7 incorporates a hollow bearing beam 11 mounted on rollers 10, and an outboard end of the beam has a fork 12 rigidly fixed thereto. Hinged in the fork 12 is an actuating mechanism in the form of a scraper 13 (FIGS. 4 and 5) with two side edges and one front edge to which a steel rod 14 is hinged for movement about a horizontal axis.

Figure 3:
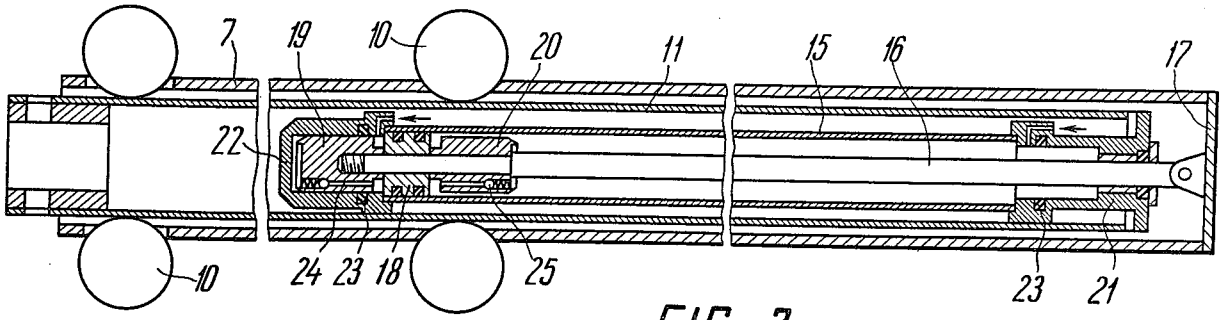
FIG. 3 is a vertical sectional view of the tubular guide bar with the beam and cylinder, taken along the longitudinal axis.

An air cylinder 15 unit (FIG. 3) is built into the bearing beam 11, with a stationsry member 16 of the cylinder being attached to a cover 17 of the tubular guide bar 7. Fastened to the stationary member 16 (rod) on both sides of a piston 18 are plungers 19 and 20. The cylinder are closed by a front cover 21 and a rear cover 22. Both covers 21 and 22 are provided with compression chambers having sealings 23. Grooves 24 of the plungers 19 and 20 accomodate built-in non-return valves 25.

The machine is controled from the cabin 9 which is equipped with a seat 26 by means of a manipulator 27 provided with a handle 28 and a pedal-operated cock 29 adapted for controlling the reversing drive 2.

Figure 2:
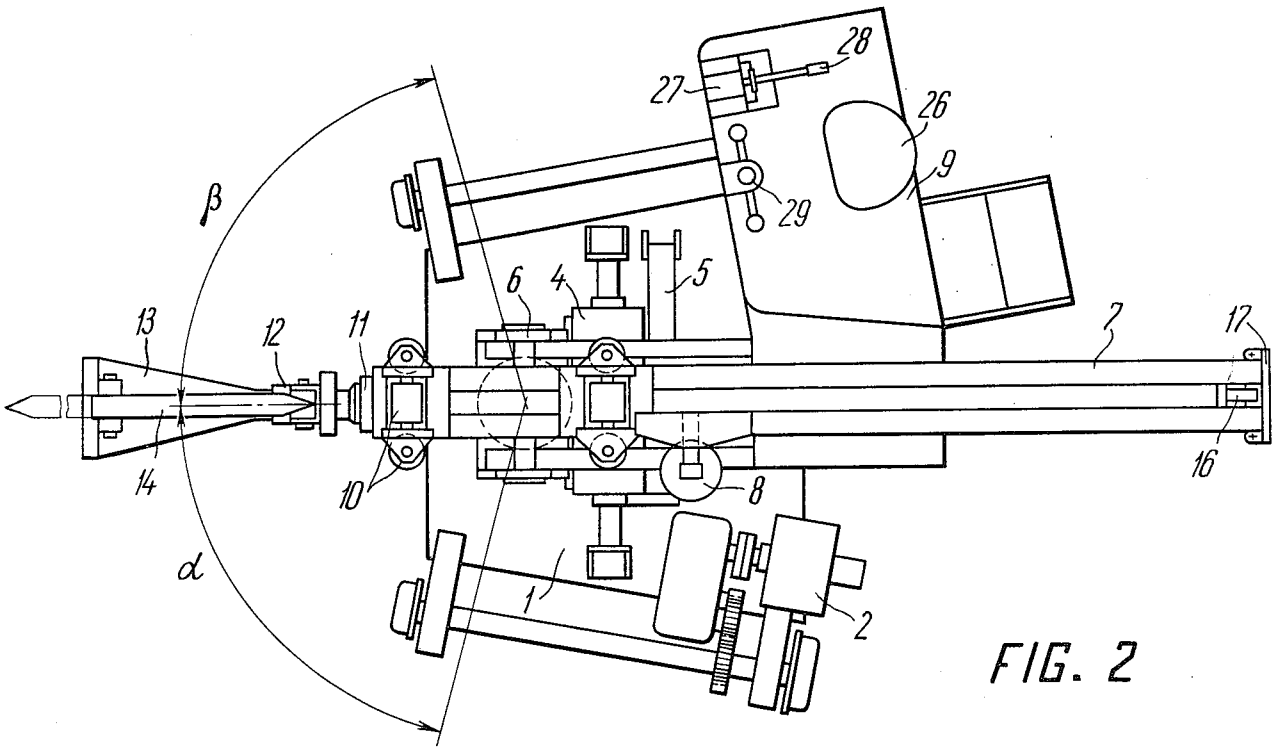
FIG. 2 is a plan view of the machine shown in FIG. 1.

The machine operates in the following manner:

In the initial position, the actuating machinism 13 of the machine is positioned outside the furnace shutters turned in relation to the axis of the column 3 at an angle $\beta$ (FIG. 2).

In order to operate in the specified zone, the machine is traversed along the circular track clockwise or anticlockwise by pushing an appropriate pedal of the cock 29 for controlling the reversing drive 2.

The actuating mechanism 13 is controlled by means of the handle 28 of the manipulator 27 whose movements are repeated by the machine actuating mechanism 13 due to alternate or concurrent actuation of the air cylinder unit 4, tilting air cylinder unit 8 and longitudinal transfer air cylinder unit 15. Thus, a complex movement of the actuating mechanism which is required for conditioning the furnace throat is being effected.

Figure 4:
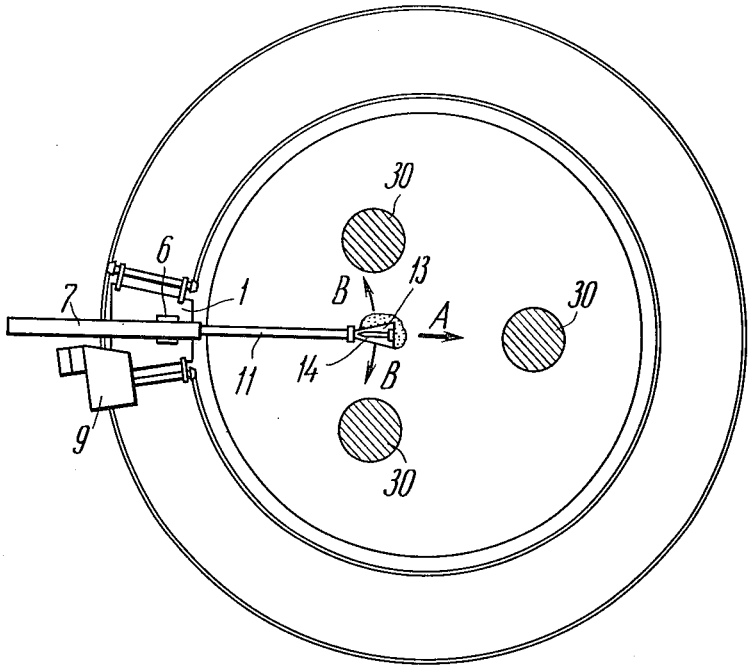
FIG. 4 is a plan view of the machine when using the scraper.
Figure 5:
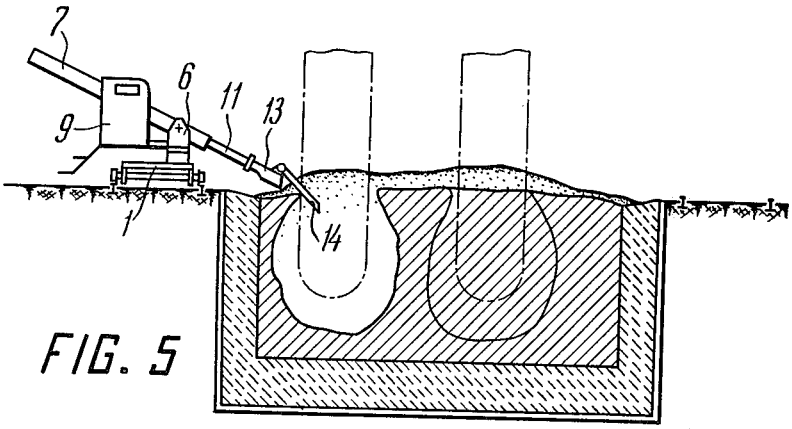
FIG. 5 is a side view of the machine when using the scraper.

Frontal raking-up is accomplished by introducing the machine actuating mechanism into the working zone of the furnace. This is effected by means of the air cylinder unit 4 (FIG. 4). With the aid of the tilting air cylinder unit 8, the tubular guide bar 7 is inclined at the requisite angle $\gamma$ so that the scraper 13 comes into contact with the throat surface. The working stroke of the scraper 13 is performed by means of the bearing beam 11 traversed by the longitudinal transfer air cylinder unit 15 with the aid of roller 10. Thus, the frontal raking-up of the charge is effected along arrow A. The side raking-up of the charge is carried out along arrow B (FIG. 4) with the aid of the longitudinal transfer air cylinder unit 15 which sets the bearing beam 11 together with the actuating mechanism 13 to a position providing the required beam span. Then, the scraper 13 is placed on the throat surface with the aid of the tilting air cylinder unit 8 and after the air cylinder unit 4 has been actuated, the charge is raked-up to electrodes 30 from the sides.

In carrying out the frontal and side raking-up of the charge the actuating mechanism is retracted.

To accomplish the poking operation, the actuating mechanism 13 (FIG. 5) is extended. With the aid of the air cylinder unit 4 and tilting air cylinder unit 8, the actuating machanism is mounted above the throat section to be subject to poling. The working stroke of the team 11 is performed by using the longitudinal transfer air cylinder 15, with the steel rod 14 descending into the furnace shaft.

When the machine is in operation, the dynamic loads arising with the longitudinal transfer aid cylinder unit in extreme positions (FIG. 3) are relieved by automatic shock absorbing devices. Thus, as the actuating mechanism is being moved to the front extreme position, the plunger 20 cuts-off a certain air volume at the inlet of the compression chamber. The air contained within the chamber is compressed thereby taking up the kinetic energy of the moving members. The non-return valve 25 is closed at that time.

To take the actuating mechanism out of the front extreme position, compressed air introduced via a sleeve in the front cover 21 of the air cylinder unit 15 opens the non-return valve flows along the groove 24 in the plunger 20 and enters the compression chamber. This causes the air cylinder unit 15 to traverse. In moving further, the plunger 20 leaves the compression chamber and compressed air being fed is admitted directly into the working space of the air cylinder unit 15.

When the actuating mechanism is being placed to its extreme rear position, the shock absorbing device operates in a similar way.

The machine running along the circular track around the furnace ensures the conditioning of the entire throat surface both a the periphery and in the interelectrode space.

The trials have proved the serviceability of the present machine as well as an adequate quality of conditioning the furnace throat.

What we claim is:

1. A machine for conditioning an ore heat-treating furnace throat comprising: a self-propelled truck; a column; means mounting said column on said self-propelled truck to be free to swing about a vertical axis; a tubular guide bar articulated to said column to be free to rotate about a horizontal axis; a hollow beam incorporated in said tubular guide bar; an actuating mechanism articulated on said hollow beam and constituting a scraper provided with two side edges and one front edge; a rod hinged on said front edge for movement about a horizontal axis; an air cylinder arranged in the interior of said beam and serving to transverse said actuating mechanism, said cylinder having a movable member and a stationary member; the cylinder movable member being articulated with said beam and the stationary member being articulated with said tubular guide bar.

2. The machine as claimed in claim 1, in which the stationary member is a piston rod having a piston and the movable member is a cylinder, covers at the opposite ends of the cylinder, a plunger mounted on the piston rod on opposite sides of the piston, and said plungers being provided with grooves having nonreturn valves for supplying compressed air into chambers provided between the plungers and the covers.

* * * * *